United States Patent [19]

Blazowich

[11] Patent Number: 4,583,798

[45] Date of Patent: Apr. 22, 1986

[54] ROTATABLE ELECTRICAL CONNECTOR

[76] Inventor: Daniel L. Blazowich, R.D. #1, Box 20, Westmoreland City, Pa. 15692

[21] Appl. No.: 735,532

[22] Filed: May 20, 1985

[51] Int. Cl.[4] ..... H01R 39/18

[52] U.S. Cl. ..... 339/8 P; 339/8 R

[58] Field of Search ..... 339/5 AU, 8 AU, 6 R

[56] References Cited

U.S. PATENT DOCUMENTS

| | | | |
|---|---|---|---|
| 1,222,585 | 4/1917 | Carlson | 339/8 PB |
| 2,224,343 | 12/1940 | Grimaldi | 339/8 PB |
| 2,288,259 | 6/1942 | Gladulich | 339/8 P |
| 3,430,180 | 2/1969 | Brown | 339/8 R |
| 4,472,010 | 9/1984 | Parnello | 339/8 R |

FOREIGN PATENT DOCUMENTS

| | | | |
|---|---|---|---|
| 1042300 | 6/1953 | France | 339/5 M |

*Primary Examiner*—Eugene F. Desmond

*Attorney, Agent, or Firm*—Jon M. Lewis

[57] ABSTRACT

A rotatable electrical connector for preventing twisting and kinking of cords such as telephone and portable appliance cords includes a shell having an open-ended cylindrical bore with a series of contact elements projecting radially inwardly from the wall of the bore and a barrel rotatably received and retained in the bore with the circumference of the barrel having a series of contact rings in alignment with the contact elements. First and second electrical connectors are provided on the ends of the shell and the barrel, respectively, with the corresponding contacts electrically connected through the contact elements and contact rings.

2 Claims, 6 Drawing Figures

ROTATABLE ELECTRICAL CONNECTOR

FIELD OF INVENTION

This invention relates to electrical connectors and, more particularly, to rotary connectors for preventing twisting of the cord connected thereto.

BACKGROUND OF THE INVENTION

The power cords used with a wide variety of hand-held appliances tend to become twisted and kinked with use as a result of the manipulation of the appliance. Similarly, telephone cords which connect the handset to the instrument and the instrument to the wall outlet develop twists and kinks in use. To prevent this twisting and the resultant kinking of the cord, a rotary connector may be provided, either in conjunction with one of the terminating plugs of the cords or as a separate member inserted at a point along the length of the cord. Prior art examples of such devices are disclosed in the following U.S. Pat. Nos.:

1,098,501: Holdaway et al
2,134,355: Caldwell
2,288,259: Gladulich
2,459,032: Korth
2,582,800: Sorenson
2,898,572: Shinn
3,321,728: Cocco et al
4,061,381: Smal
4,026,618: Straka It is the primary object of the present invention to provide an improved rotary electrical connector characterized by its simplicity of construction and reliability of operation.

SUMMARY OF INVENTION

The above and other objects of the invention which will become apparent hereinafter are achieved by the provision of a rotary or swivel connector having an outer shell with a cylindrical bore, a plurality of contact members extending radially inwardly from the cylindrical wall of the bore, a barrel rotatably received in the bore and having an equal plurality of radially outwardly extending contact rings in alignment with the contact members, one of the shell and barrel having a male electrical connector and the other having a female connector and each including conductors connecting the contact elements of the male or female connectors to the contact members or rings.

For a more complete understanding of the invention and the objects and advantages thereof, reference should be had to the accompanying drawings and the following detailed description wherein a preferred embodiment of the invention is illustrated and described.

DETAILED DESCRIPTION OF THE PREFERRED EMBODIMENT

Figure 1:
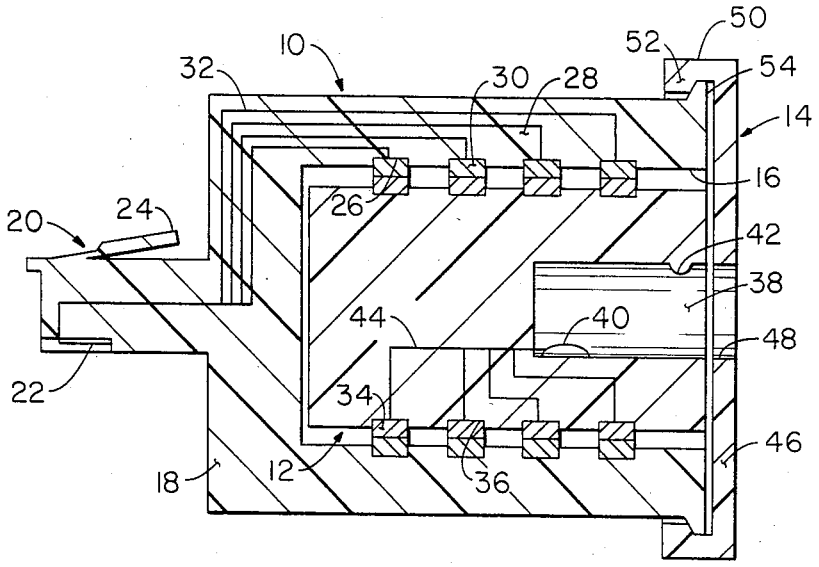
FIG. 1 is a longitudinal cross-sectional view of a first embodiment of the swivel connector of the present invention.

The embodiment of the invention depicted in FIG. 1 is intended for use with telephone cords such as are used to connect the telephone handset to the instrument or the instrument to the outlet. The connector includes a shell 10, a barrel 12 received within and rotatable relative to the shell and a retainer ring 14.

The shell 10 is, preferrably, of molded plastic construction and has a cylindrical bore 16 extending inwardly from one end thereof and terminating in an end wall 18. Projecting from the outer or rear face of the wall 18 and, preferably, molded integral therewith is a male phone jack 20 of the modular type now widely used in telephone wiring. As is conventional in a modular jack, four contact wires 22 are provided for engagement with corresponding contacts in the mating socket and a resilient latch bar 24, for retaining the jack in the socket. Four annular grooves 26 are formed on the cylindrical wall 28 of the bore 16, each groove receiving an annular contact wire 30 with the wire extending radially inwardly beyond the wall surface. Suitable conductors 32 are incorporated into the shell 10 and serve to connect the annular contact wires 30 to the jack contact wires 22, each annular contact wire being connected to a separate jack contact.

The barrel 12, also of molded plastic construction, is of a length substantially equal to the depth of the bore 16 and of the diameter slightly less than that of the bore. Four contact wire rings 34 are carried in grooves 36 on the circumference of the barrel, the rings being in alignment with the annular contact wires 30 of the shell and of such diameter as to maintain rubbing contact therewith. Extending inwardly from the outer face of the barrel is a socket 38 of the configuration corresponding to that of a standard modular phone jack socket and including four contact wires 40 and lugs 42 for engagement by the wire contacts and latching bar, respectively, of a modular phone jack. Conductors 44 are provided in the barrel for connecting the respective contacts 34 to the wire contacts 40.

The retainer ring or cap 14 includes a circular end wall 46 having a central opening 48 of sufficient size to pass a modular jack but of lesser diameter than the barrel 12. An annular wall 50 is provided at the circumference of the circular wall and terminated in an inwardly projecting annular flange 52. The outer wall of the shell 10 adjacent the open end thereof is formed with a radially outwardly projecting flange 54 with the flanges 52 and 54 being sized to permit the cap 14 to be snapped into place on the shell 10.

Figure 2:
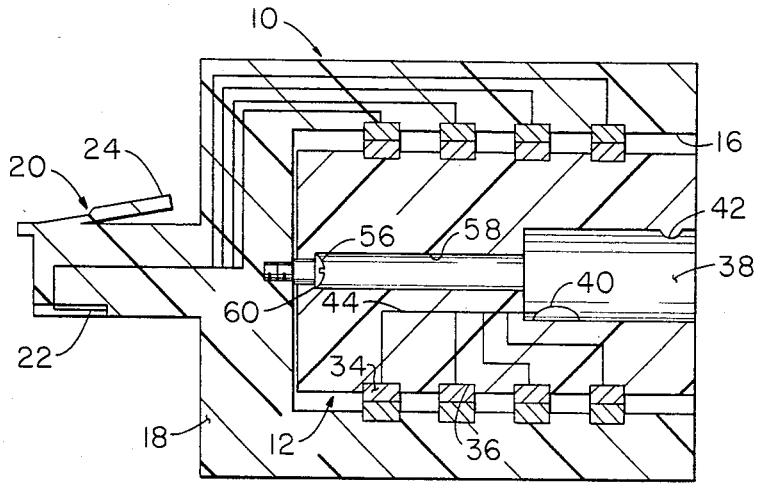
FIGS. 2 and 3 are views similar to that of FIG. 1 but showing modifications of the connector.

Illustrated in FIG. 2 is a second embodiment of the swivel connector of the present invention. In this embodiment, the barrel 12 is retained in the shell 10 by means of a screw 56 threaded into the end wall 18 of the shell, a small diameter bore 58 having a shoulder 60 extending axially inwardly for the socket opening 38 for receiving the screw 58.

Figure 3:
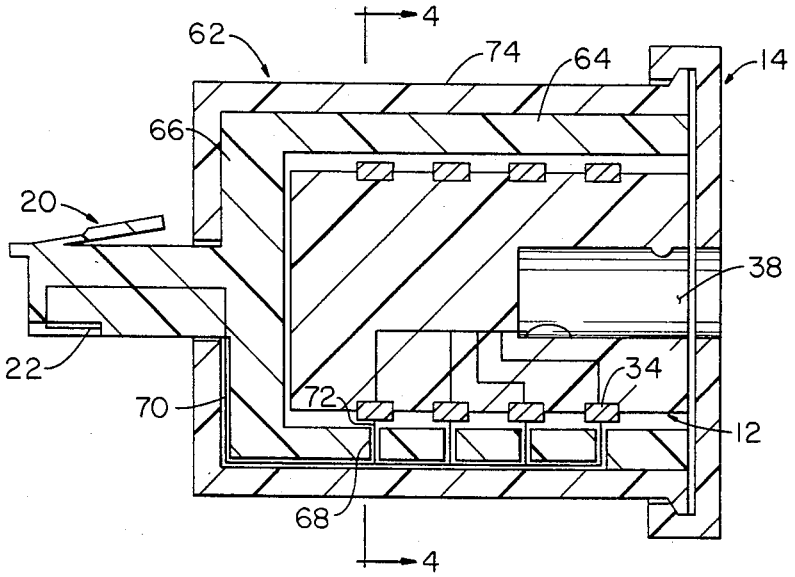

Having reference now to FIGS. 3 and 4, a further modification of the invention will be described. The barrel 12 and retainer 14 of this embodiment may be of the same configuration as are shown in FIG. 1 while the shell assembly 62 is of multiple part construction. The shell assembly includes an inner member having a cylindrical wall 64 and an end wall 66 defining the barrel receiving bore. The jack 20, in this embodiment, is molded integrally with the inner member. In alignment with the contact rings 34 of the barrel 12, holes 68 are provided through the cylindrical wall 64. Connected to each of the jack contact wires 22 is a conductor wire 70, a separate conductor wire being provided for each contact wire, and these conductor wires extend along the exterior of the inner member and through one of the holes 68, the end 72 of the conductor wire being of sufficient length as to project radially inwardly through the corresponding hole. Surrounding the inner member is an outer shell 74 which closely overlies the inner member and serves to bias the wire ends 72 inwardly to assure electrical contact with the conductor rings 34 of the barrel 12.

Figure 4:
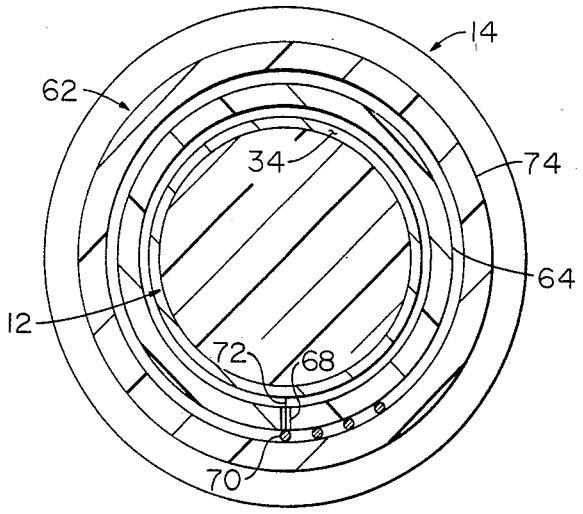
FIG. 4 is a transverse cross-sectional view taken on the line 4—4 of FIG. 3.
Figure 5:
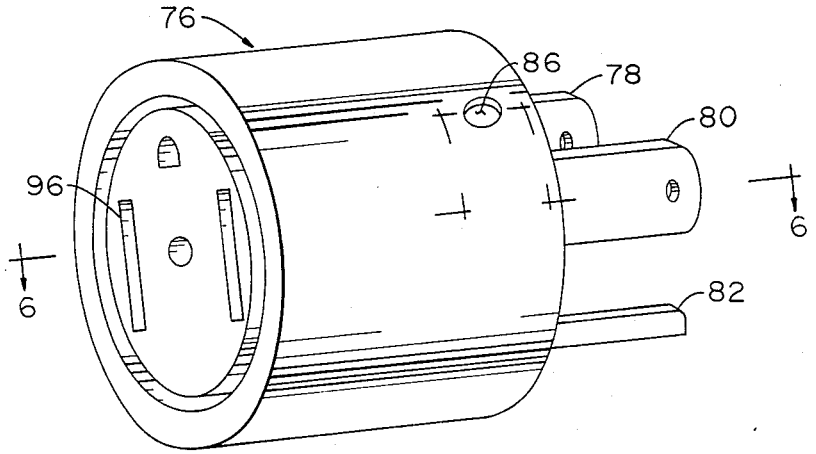
FIG. 5 is a perspective view of a further modification of the connector of the present invention.
Figure 6:
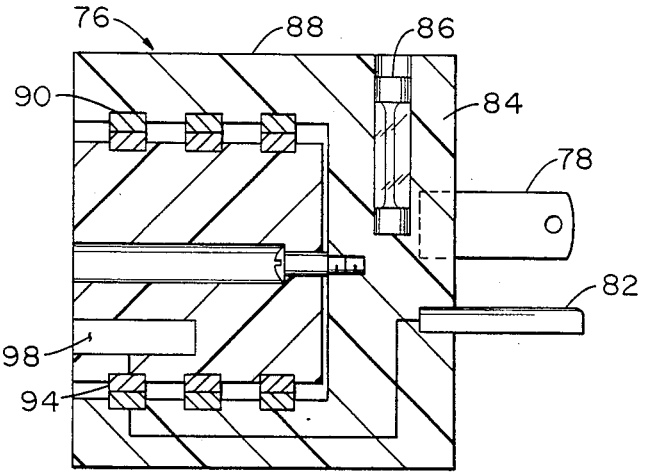
FIG. 6 is a longitudinal cross-sectional view taken on the line 6—6 of FIG. 5.

A further modification of the swivel connector adapted for use with portable appliances and power tools is shown in FIGS. 4 and 5. In this embodiment, the shell 76 is provided with three prongs 78, 80, 82 for engagement with the line, neutral and ground contacts, respectively, of a conventional outlet socket. If desired, the end wall 84 of the shell may be enlarged to provided space for a fuse receptacle 86. The cylindrical wall 88 of the shell carries, on its inner surface, three contact rings 90, each connected to a respective one of the prongs. In the event a fuse is provided, the connection to the line prong is in series with the fuse. The barrel is, likewise, provided with three contact rings 94 and with openings 96 having suitable contact blades 98 for engagement with conventional plug prongs.

It will be understood that while preferred embodiments of the invention has been illustrated and described, changes and additions may be made therein and thereto without departing from the spirit of the invention. Reference should, accordingly, be had to the appended claims in determining the scope of the invention.

I claim:

1. A rotatable electrical connector for use with flexible cords to prevent twisting and kinking thereof comprising:

a. a shell of molded plastic material having a cylindrical side wall and an end wall together defining a cylindrical bore extending axially inwardly from one end thereof, a first electrical connector extending from said end wall and having a plurality of electrical contact members, an equal plurality of electrical contact elements carried by and projecting radially inwardly from said cylindrical wall, and an equal plurality of conductors each connecting one said contact member to one said contact element;

b. a barrel of molded plastic construction, of a diameter slightly less than that of said bore and having an equal plurality of electrical contact rings on the circumference thereof in alignment and engagement with said contact elements, a second electrical connector of complementary configuration to said first electrical connector extending inwardly from an end of said barrel and having an equal plurality of electrical contact members, and an equal plurality of conductors each connecting one of said last mentioned connectors to one of said rings;

c. means for rotatably retaining said barrel in said shell;

d. means for retaining said barrel comprises a retainer cap having a top wall partially overlying the end wall of said barrel, an annular side wall and a radially inwardly projecting flange connected to said side wall in spaced relation to said top wall, the cylindrical wall of said shell having a cooperating, radially outwardly projecting flange adjacent the open end of said shell; and e. said shell includes an inner cylindrical member having an equal plurality of holes therethrough in alignment with said rings of said barrel, said contact elements comprising wire end portions projecting radially inwardly through said holes, and said shell further includes an outer cylindrical member closely overlying said inner member and biasing said wire ends radially inwardly.

2. The rotatable electrical connector of claim 1 wherein said first and second electrical connectors are of the configuration of modular telephone wiring connectors.

* * * * *